United States Patent [19]

McGovern

[11] 4,330,771

[45] May 18, 1982

[54] PENDULUM SWITCH

[76] Inventor: James R. McGovern, 205 E. 239th St., Bronx, N.Y. 10470

[21] Appl. No.: 147,109

[22] Filed: Jul. 31, 1980

[51] Int. Cl.[3] ..... H01H 36/00; H01H 3/00

[52] U.S. Cl. ..... 335/205; 362/806

[58] Field of Search ..... 335/205, 219, 189, 190, 335/195; 362/806-808, 394, 398; 200/153 F, 337, 324; 307/139, 140, 142, 157

[56] References Cited

U.S. PATENT DOCUMENTS 3,223,412 12/1965 Freeman et al. ..... 362/808 X

*Primary Examiner*—George H. Miller, Jr.
*Assistant Examiner*—Stafford D. Schreyer

[57] ABSTRACT

An on-off switch that is activated by momentary application of an electromagnetic force to any tangent on the circumference, in the upper portion, of the units housing.

1 Claim, 5 Drawing Figures

PENDULUM SWITCH

BRIEF DESCRIPTION THE INVENTION A switch device wherein a momentary application of an electromagnet so that it touches any point on the circumference, in the upper portion, of the units housing, displaces a magnetically responsive bar that is fastened to a spring loaded line, so that the line snaps against a shuttle carrying ram that "pops" a pendulum and causes it to flip a cam up and then engage a lip on the cam and establish a circuit through the pendulum and the cam; a subsequent momentary application of the electromagnet then "popping" the ram shuttle so that as it is returning to a neutral position, a lever extending down from its arm engages a cam lift extending up from the cam, and lifts the cam so that it disengages from contact with the pendulum and breaks the circuit.

BRIEF DESCRIPTION OF THE SEVERAL VIEWS

DETAILED DESCRIPTION OF THE INVENTION

Figure 5:
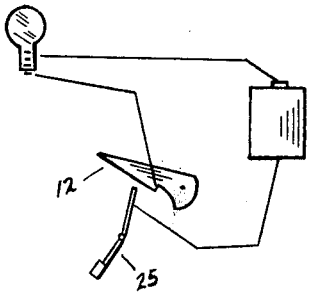
FIG. 5 shows the use of a pendulum switch in a simple circuit.

The manner of making this invention would be as follows: refer to FIG. 1 and construct a pendulum switch 1; provide a cylinder-like unit housing 2 with a disc-like line guide 3 fastened a nominal distance down from the top and within the housing 2 and fasten a pulley 4 mounted on a bracket 5 on top of the guide 3 provide an elongated guide hole 44 in the side of the housing 2. The hole could either be drilled or molded into the housing 2. Further down the housing 2 fasten a disc-like platform 6 with a stabelizer 7 mounted in its center. Insert a vertical flexible rod 8 into the stabelizer 7 and mount a cylindrical bar 9 that has a magnetically responsive jacket on the unfastened end of the rod 8.

Figure 2:
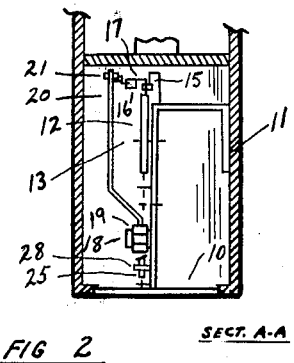
FIG. 2 is a section of the switch mechanism as shown in FIG. 1.
Figure 1:
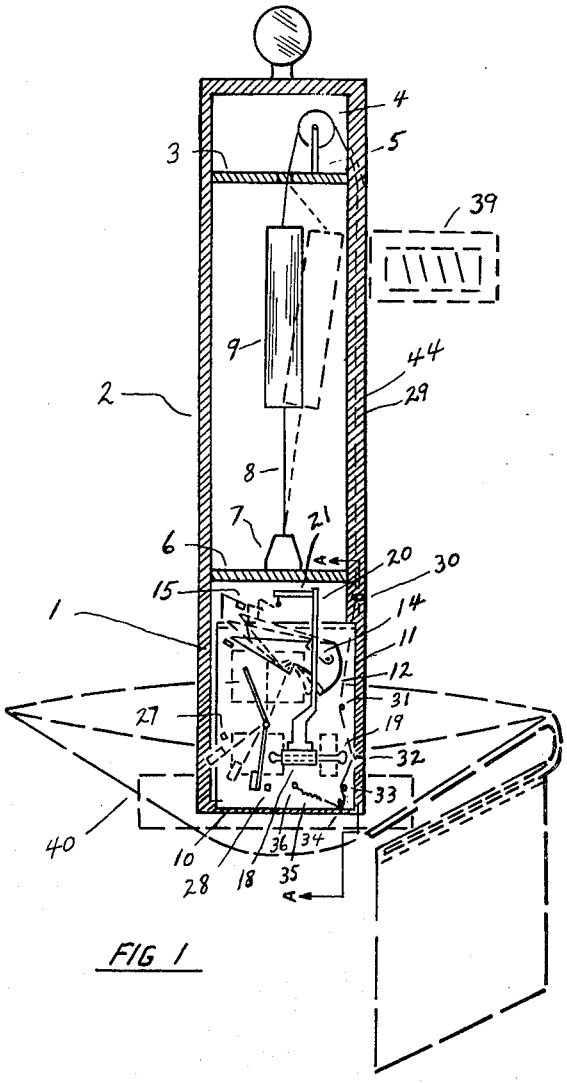
FIG. 1 is a cross section of the invention which shows the pendulum switch mechanism and a simulated view of the inventions operation and use.

Refer to FIGS. 1 and 2 and on the bottom of the housing 2 fasten a base plate 10 with a switch mechanism structural support 11 fastened to it. Fasten the upper leg of the support 11 to the interior side of the housing 2.

Figure 4:
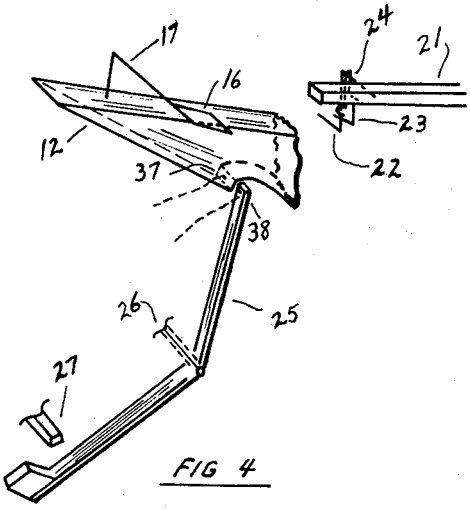
FIG. 4 is an enlarged view of the pendulum/cam contact arrangement and the cam disengaging levers.

Mount a cam 12 on pivot 13 on the support 11 and provide a cam tension spring 14 with one end overlapping and pulling down on the top of the cam 12 and the other end wrapped around the cam pivot 13. Near the tip of the cam 12 provide a stop 15 mounted on the support 11. Refer to FIGS. 2 and 4 and provide a spatula-like cam lift 16 mounted on a holder 17 that is fastened to the top surface near the tip end of the cam 12.

Figure 3:
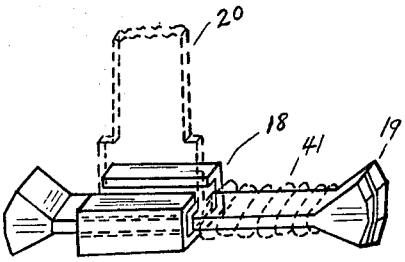
FIG. 3 is an enlarged view of the switch mechanism ram.

Refer to FIGS. 1, 3, and 4, and provide a shuttle block 18 fastened to the lower portion of the support 11. Provide a pendulum ram 19 with a post 20 projecting vertically up from its top surface. Shape the center section of the ram 19 so that it will fit within the interior shape of the block 18 and be free to slide back and forth laterally within the block 18. Provide a coil tension spring 41 to return and stabelize the ram in its neutral position after activation.

Provide a cam lift shuttle arm 21 that is rigidly fastened to and projecting horizontally out from the top of the post 20.

Provide a Z shaped cam lift lever 22 with its top horizontal leg set into the side of the arm 21 and its bottom horizontal leg hanging down into a line of encounter with the cam lift 16.

Provide an L shaped cam lift lever stop 23, its vertical leg set in the underside of the arm 21 and projecting downward so that its horizontal arm will encounter and limit the travel of the lever 22.

Provide a tension spring 24 that will apply light pressure to hold the lever 22 against the stop 23.

Provide a pendulum 25 on a pivot rod 26 that is mounted on the long vertical leg of support 11 and pendulum stops 27 and 28 that are fastened to support 11, to encounter and limit the turning motion of the pendulum 25.

Refer to FIG. 1 and provide a line 29 fastened to the top of bar 9 and extending through guide 3, over pulley 4, through guide 3 down through guide hole 44, under guide 30, over guide 31, through the eye of tension spring 32, over guide 33, around guide 34, and fastened to one end of coil spring 35. Fasten the opposite end of coil spring 35 to line anchor pin 36 which is set in the long vertical leg of the support 11.

Refer to FIG. 4 and provide a contact surface 37 mounted on the cam 12 lip and a contact surface 38 mounted on the top end of the pendlum 25.

This would complete the construction of a pendlum switch 1.

The stabelizer 7 could be made of a sponge rubber like material, the line 29 could be made of nylon or similar material, the springs 14, 24, and 35, and contacts 37 and 38 could be made of metal, and the other parts could be made of metal or plastic.

OPERATION OF THE INVENTION

FIG. 1 shows the simulated application of an electromagnet 39 to the unit 1 housing 2 and a simulated battery 40 unit holder 42 and light 43.

Momentary application of an electromagnetic force to the unit 1 housing 2 snaps the bar 9 against the interior surface of the housing 2 and in doing so jerks the line 29 against the ram 19. The ram 19 snaps forward and pops the pendulum 25 causing it to move forward and its top portion to encounter the cam 12 and flip it up. The cam lift arm 21 is moved forward also as it is an extension of the ram 19. The lift lever 22 on the arm 21 moves through the area that the spatula-like cam lift 16 occupies in its full up position, which is slightly higher than its contact position, before the cam lift 16 reaches the full up position, and therefore misses encountering the lift 16. The pendulum 25 is stopped when it encounters stop 27 and as its reverse movement starts it encounters the contact 37 lip on the cam 12 and hangs-up and establishes a completed circuit condition—contact 37 on contact 38.

A subsequent momentary application of an electromagnetic force to the unit 1 housing 2 snaps the bar 9, and jerks the line 29 against the ram 19 and snaps it forward to its limit. As the cam lift arm 21 advances, the lift lever 22 encounters and overrides the cam lift 16 as the lever 22 is displaced counterclockwise. In the return movement of the arm 21 the lever 22 with its clockwise movement stopped by 23 encounters and underrides the cam lift 16 and lifts it and the cam 12 up, thereby releasing the pendulum 25 and disestablishing the completed circuit.

USE OF THE INVENTION

This invention, a switch, is used in a battery powered Christmas tree light unit and can be turned on or off by application of a momentary electromagnetic force—to any point—on the upper vertical surface of the units non-metalic tube-like housing. No matter how inaccessable the light unit may seem in its placement on a Christmas tree if the unit can be reached the switch can be actuated.

On the above application I claim the following:

1. An on-off light switch device comprising a cylinder housing, a magnetically responsive bar set on a flexible rod that is set in a flexible mound, a line that is fastened to said bar at one end and extends from there past a ram, cam, and pendulum mechanism, and is then fastened to an anchored coil spring, said pendulum and said cam each containing complimentary contact points which when joined complete what constitutes a usable circuit, said pendulum's clockwise and/or counterclockwise movement being limited by stop pins, said cam's clockwise movement being retarded by spring and its counterclockwise movement being limited by stop pin, said ram being contained in a shuttle block and free to move back and forth horizontally under the influence of a light return spring pressure, said cam containing a cam lift on its top surface, said ram containing a cam lift arm post, a cam lift shuttle arm, and a cam lift lever, and all of the aforementioned apparatus arranged so that initial momentary application of an electromagnetic force to any point on the circumference of said housing's upper vertical surface will produce a typical sequence of action in said switch amounting to snapping said bar against the interior surface of said housing and in so doing, jerk said line against said ram snapping it forward so that it pops said pendulum and causes it to swing and its top to encounter said cam and to brush along the lower side of said cam causing said cam to flip up and hang up on the top portion of said pendulum thereby establishing a circuit completing contact to be made between said pendulum and said cam; the forward movement of said ram having been accompanied by the forward movement of said cam lift arm, said lift lever on said arm moving through the area that said cam lift occupies in its full-up position, which is slightly higher than its contact position, before said cam lift reaches a full-up position, and therefore misses encountering said cam lift; and subsequent momentary application of said electromagnetic force to said housing, snaps said bar and jerks said line against said ram and snaps it forward to its limit, however said cam lift lever in this subsequent sequence encounters and overrides said cam lift in its forward movement as said lever is displaced counterclockwise, and then encounters and its clockwise movement stopped as it underrides and lifts said lift and cam thereby releasing said pendulum and disengaging said completed contact.

* * * * *